United States Patent [19]

Corkill

[11] Patent Number: 4,575,308

[45] Date of Patent: Mar. 11, 1986

[54] SOLID MATERIALS PUMP

[75] Inventor: William M. Corkill, White Sulphur Springs, Mont.

[73] Assignee: Metal Technologies, Inc., Mont.

[21] Appl. No.: 562,283

[22] Filed: Dec. 15, 1983

[51] Int. Cl.[4] ..... F04D 7/02

[52] U.S. Cl. ..... 415/213 A; 415/206

[58] Field of Search ..... 415/203, 206, 213 A; 416/189 R, DIG. 3

[56] References Cited

U.S. PATENT DOCUMENTS

| | | | |
|---|---|---|---|
| 3,510 | 3/1844 | Johnson . | |
| 3,959 | 3/1845 | Aylsworth . | |
| Re. 24,803 | 8/1953 | Burnside | 415/206 |
| 1,161,701 | 11/1915 | Le May . | |
| 2,635,548 | 4/1953 | Brawley | 415/204 |
| 2,958,293 | 11/1960 | Pray, Jr. | 415/206 |
| 3,190,226 | 6/1965 | Judd | 415/206 |
| 3,269,325 | 8/1966 | Schwed et al. | 415/213 A |
| 3,319,573 | 5/1967 | Judd | 415/206 |
| 3,679,323 | 7/1972 | Buck . | |
| 3,759,628 | 9/1973 | Kempf | 415/206 X |
| 3,953,552 | 4/1976 | Strauss . | |

FOREIGN PATENT DOCUMENTS

| | | | |
|---|---|---|---|
| 1528647 | 5/1969 | Fed. Rep. of Germany . | |
| 1301599 | 8/1969 | Fed. Rep. of Germany . | |
| 2353456 | 4/1975 | Fed. Rep. of Germany | 416/DIG. 3 |
| 1466834 | 12/1966 | France . | |

OTHER PUBLICATIONS

Warren Vortex Centrifugal Pumps 3302 Series, Section 3302, p. 3302.2, Issue B.

WEMCO-HIDROSTAL PUMPS, Screw-Centrifugal Impeller Offers High Frequency, Clog-Free Pumping.

PAPCO PUMPS Type LF-Frame Mounted End-Suction Pumps AD1A.

*Primary Examiner*—Everette A. Powell, Jr.

*Attorney, Agent, or Firm*—Mason, Fenwick & Lawrence

[57] ABSTRACT

A rotary pump is disclosed for pumping liquid and solid materials carried in suspension therein. The rotary pump comprises an impeller and a housing. The housing forms a swirl chamber and an impeller chamber for receiving the impeller. The impeller is mounted rotationally within the impeller chamber for rotation in a given rotational direction. The impeller comprises a surface exposed to the swirl chamber and disposed substantially outside the swirl chamber, and a plurality of pockets recessed in the exposed surface. Each of the recessed pockets comprises a blade surface having a curved surface. The curved surface redirects the pumped liquid thereabout as the impeller is rotated, whereby the liquid and suspended solid materials are formed into a swirling vortex of increased rotational velocity to substantially prevent the solid materials from striking and damaging the impeller.

10 Claims, 7 Drawing Figures

3
18
20
22
10
16
55
53
14
26
12
24
28
3

50
70
16
31
53
62
52
14
32
18
20
22
96
94
30
84
76
74
26
24

10
18
4
20
r
a
36
b
12
22
95
83
78
80
76
74
86
84
92
96
68
62
36
53
94
50
38
64
70
92
90
96
82
14
54
63
16
40
30
32
42
26
34
4

10
18
61
66
56
52
63
58
67
25
62
54
60
65
50
24
25
34
42
26

SOLID MATERIALS PUMP

FIELD OF THE INVENTION

This invention relates to pumps and, in particular, to pumps capable of pumping a liquid carrying a relatively large percentage of solid materials.

DESCRIPTION OF THE PRIOR ART

It is highly desired to use pumps for moving solid materials carried in a liquid, the liquid and solid materials being termed a slurry. Such pumps may be used for pumping out sumps of different kinds and in mining operations, wherein the ore to be collected is found in a body of water. In particular, the mining of gold may be carried out with the use of such a pump and a hose connected thereto. The disconnected end of the hose is positioned along the bottom of a creek or small river containing gold nuggets and a slurry is drawn from the creek and discharged into a suitable container, which allows the water to flow away leaving the gold nuggets.

It is typical to employ a reciprocating pump for forcing a liquid through a delivery hose. Reciprocating pumps employ pistons that exert a pulsating pressure to the liquid to be pumped. Unfortunately, the pulsating pressure does not readily serve to carry the liquid and the solid materials carried thereby.

By contrast, rotary pumps and, in particular, centrifugal pumps are more adapted to pumping slurries. The problem encountered by centrifugal pumps of the prior art is that the conveyed solid materials strike destructively the impeller or rotor of the pump. Further, the conveyed particles may also cause damage to the pump housing, which may be almost completely filled with a rotating impeller or the like. Such a structure requires that the solid materials pass through a relatively narrow passage from an inlet aligned with the center of the impeller to a peripherally disposed outlet. Thus, the size of the solid materials that may pass through the pump housing is limited. Further, the impact of the solid materials upon the impeller and the pump housing cause rapid damage thereto, requiring costly shutdowns for maintenance and repair.

U.S. Pat. No. 2,635,548 of Brawley describes a centrifugal pump that is particularly designed to pump liquids carrying solid materials. The Brawley pump comprises a housing in which there is disposed an impeller that is rotatively driven to exert a rotating effect upon the liquid drawn into the pump and its swirl or pump chamber. The impeller is displaced from the swirl chamber so as not to interfere with the solid materials drawn through the swirl chamber. The impeller includes a plurality of blades that may be disposed either radially of its drive shaft or tangentially thereto. The slurry is introduced by an inlet disposed coaxial with the drive shaft of the impeller, and is centrifugally directed to a peripheral portion of the swirl chamber. Finally, the slurry is exited via an outlet that is disposed tangentially of the pump housing. The blades of the impeller impart rotation to the mass of liquid introduced into the pump housing forming a vortex, which may be likened unto a hurricane. The liquid and solid materials are rotated or swirled at relatively high velocity, exerting a centrifugal force on the solid materials, which are directed to the outer circumference of the swirl chamber.

U.S. Pat. No. 2,958,293 of Pray, Jr. discloses a similar type of pump for forming the inputted slurry into a vortex that is rotated at a relatively high velocity. The impeller includes a plurality of tangentially disposed vanes and a solid peripheral portion to form pockets. The leading edge of the vanes has a concave curvature that is disposed in a parallel relationship to the opposing surface of a chamber housing. The configuration of the vanes and the pump housing serve to permit the flow of the slurry therethrough without damage to the impeller vanes.

The effectiveness of solid material pumps depends, in part, upon the velocity that is imparted to the pumped fluid. It can be seen that as the velocity of the liquid is increased that the acceleration imparted to the solid materials carried by the pump liquid is increased to direct them rapidly from the inlet to the outlet without striking the impeller. The effect of the vortex, as formed by the impeller, is increased, thus, further tending to prevent solid materials from striking the impeller. In this regard, if the solid materials were permitted to strike the impeller, the impeller being one of the more fragile and expensive elements of the pump, would be damaged and its effective life shortened.

SUMMARY OF THE INVENTION

It is therefore an object of this invention to provide a new and improved solid materials pump that increases the velocity of the liquid carrying the solid materials.

It is a more particular object of this invention to provide a new and novel solid materials pump that increases the efficiency and effect of the vortex created thereby, thus, reducing the possibility that the solid materials will strike and damage the rotating impeller thereof.

In accordance with these and other objects of this invention, there is disclosed a rotary pump for pumping liquid and solid materials carried in suspension therein. The rotary pump comprises an impeller and a housing. The housing forms a swirl chamber and an impeller chamber for receiving the impeller. The impeller is mounted rotationally within the impeller chamber for rotation in a given rotational direction. The impeller comprises a surface exposed to the swirl chamber and disposed substantially outside the swirl chamber, and a plurality of pockets recessed in the exposed surface. Each of the recessed pockets comprises a blade surface having a curved surface. The curved surface redirects the pumped liquid thereabout as the impeller is rotated, whereby the liquid and suspended solid materials are formed into a swirling vortex of increased rotational velocity to substantially prevent the solid materials from striking the impeller.

BRIEF DESCRIPTION OF THE DRAWINGS

While the specification concludes with claims particularly pointing and distinctly claiming the subject matter of the invention, it is believed that the invention will be better understood from the following description taken in conjunction with accompanying drawings, wherein:

DESCRIPTION OF THE PREFERRED EMBODIMENT

Figure 1:
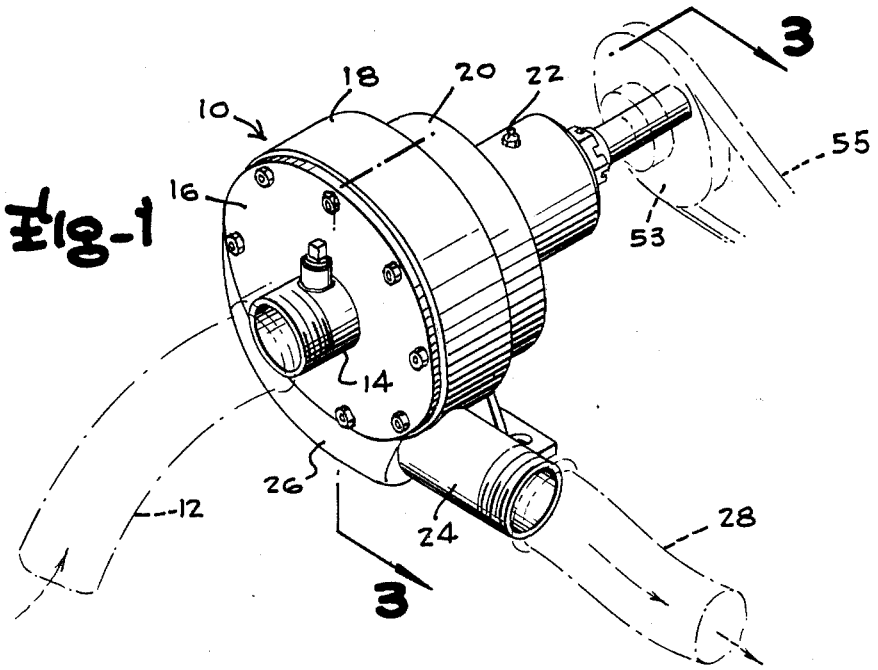
FIG. 1 is a perspective view of a solid materials pump in accordance with the teachings of this invention.
Figure 2:
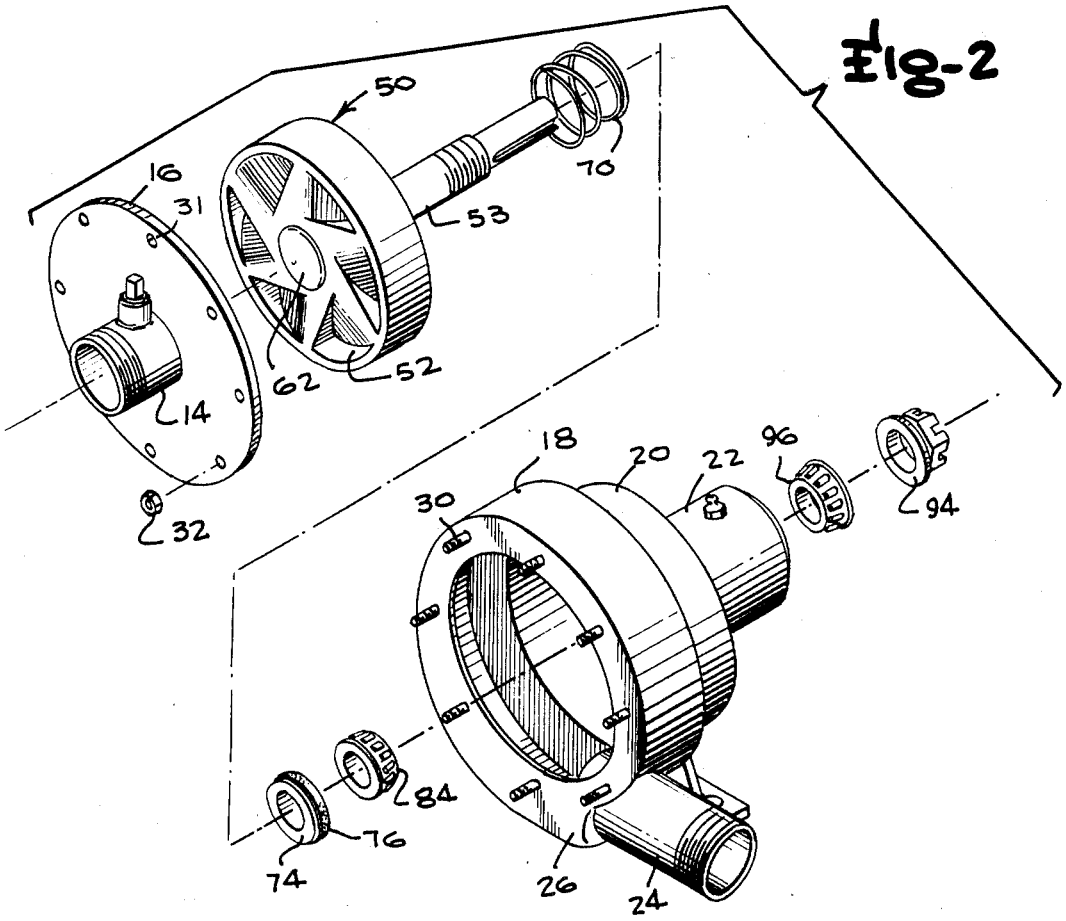
FIG. 2 is a perspective view showing the assembly of an impeller within the housing of this invention.
Figure 3:
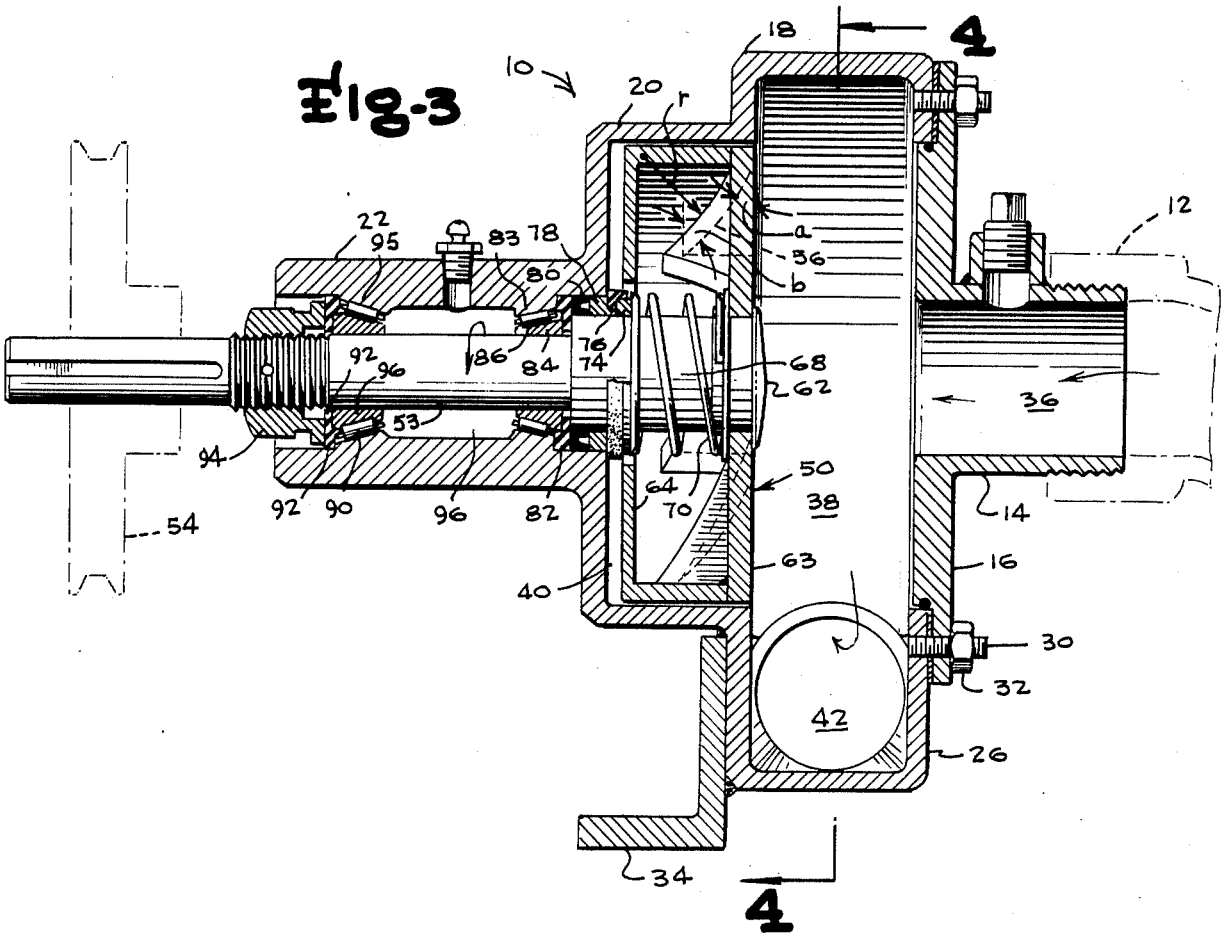
FIG. 3 is a sectioned view of the solid materials pump as taken along line 3—3 of FIG. 1.
Figure 4:
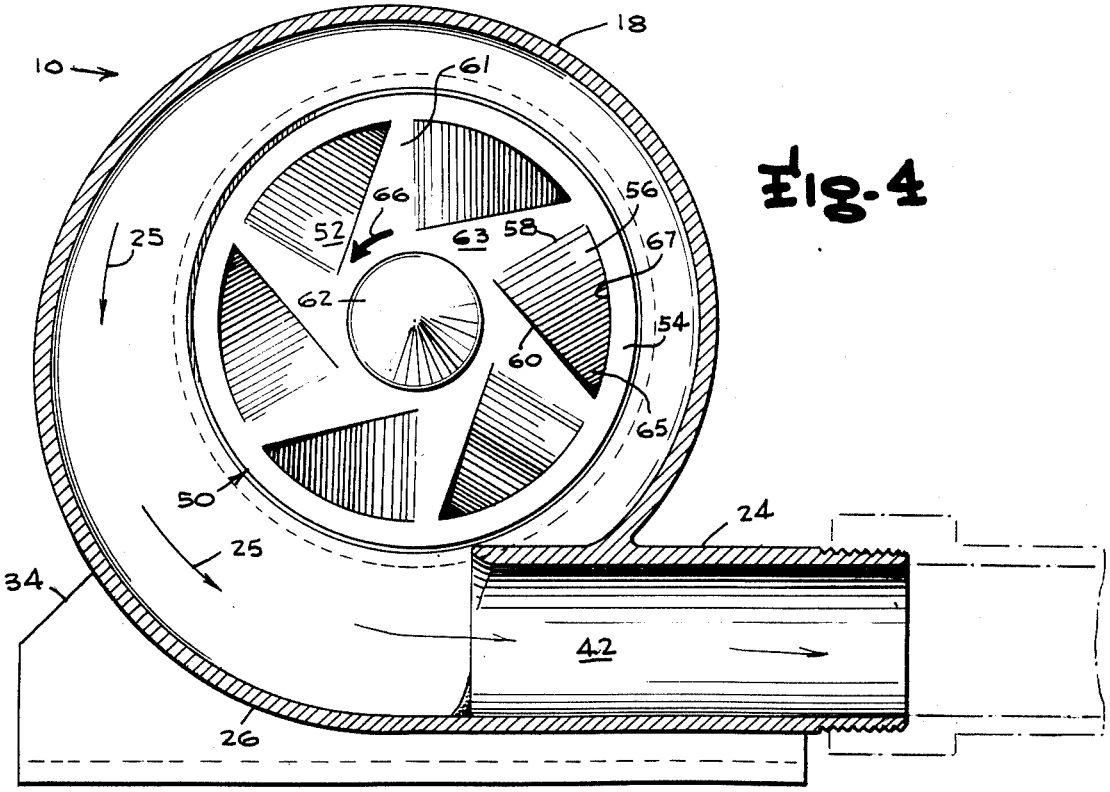
FIG. 4 is a front, sectioned view of the solid materials pump as taken along line 4—4 of FIG. 3.

Referring now to the drawings and, in particular, to FIG. 1, there is shown a solid materials pump 10 in accordance with the teachings of this invention. The pump 10 includes an inlet 14 coupled to an inlet conduit 12 through which a slurry carrying the solid materials is introduced into the pump 10. As shown in FIGS. 2 and 3, an impeller 50 serves to pump a slurry via an outlet 24 to an outlet conduit 28. The pump 10 comprises an outside wall 18 enclosing and defining therein, as shown in FIGS. 2 and 3, a pump chamber 38 for receiving the slurry and for directing the slurry in a swirling pattern or vortex along a path defined by a transition bonnet 26 to the outlet 24. This path is illustrated by a series of arrows 25, as shown in FIGS. 3 and 4.

The impeller 50 includes a drive shaft 52 that is fixedly attached to a drive pulley 53, which is in turn rotatively driven by a drive belt 55. As shown in FIGS. 2 and 3, the impeller 50 is mounted in a close-fitting relationship within an impeller chamber 40 as defined by an impeller housing 20. The drive shaft 52 is rotatably mounted by a pair of bearings 84 and 96 disposed within a bearing housing 22, as shown in FIG. 3. The impeller 50 includes a plurality of recessed pockets 56 designed in accordance with the teachings of this invention to increase the velocity flow of the slurry through the solid materials pump 10. The pump chamber 38 is enclosed by a cover plate 16, which is attached to the pump 10 by a plurality of screws 30. The screws 30 are aligned with a like plurality of openings 31 within the cover plate 16. In turn, a plurality of bolts 32 is threadably received by the screws 30 to thereby secure the cover plate 16 to the outside wall 18.

Referring now to FIG. 3, the rotative mounting of the drive shaft 52 is shown. The bearing housing 22 defines a lubrication reservoir 96 for receiving and rotatively mounting the drive shaft 52. A pair of conically shaped bearing surfaces 83 and 95 receives, respectively, bearings 84 and 96, each affixed to the drive shaft 52. A locknut 94 is threadably attached to the drive shaft 52 to secure the drive shaft 52 to the bearing housing 22.

A collar 74 is disposed about the drive shaft 52 for positioning a spacing spring 70 also disposed about the drive shaft 52. The spacing spring 70 exerts a force tending to dispose the impeller 50 to the right, as seen in FIG. 3. A compressible seal 76 is disposed to abut against the collar 76 to prevent the loss of fluid from the pump chamber 38 or the impeller chamber 40 and into the lubrication reservoir 96. Further, an annular spacer 78 is disposed about the drive shaft 52 and abuts on one side with the compressible seal 76 and on the other side with a compressible seal 80. A bearing seal 82 is disposed between the bearing 84 and the compressible seal 80. An annularly shaped bearing seal 92 is disposed between the bearing 96 and the locknut 94 to prevent lubrication loss.

The configuration of the impeller 50 is best shown in FIGS. 3 and 4. The impeller 50 includes a plurality of pockets 52 formed in accordance with the teachings of this invention. The pockets 50 are recessed in that no surface thereof extends beyond the periphery of the impeller 50 and into the pump chamber 38, as shown in FIG. 3. The impeller 50 includes a leading surface 63 of a substantially planar configuration. The plurality of pockets 52 extend inwardly of the impeller 50 and away from the leading surface 63. As shown in FIGS. 3 and 4, the impeller 50 includes an outer ring 54 forming an inner surface 67 of substantially cylindrical configuration. An annularly shaped member 64 is rearwardly spaced from the surface 63, as shown in FIG. 3, and is affixedly attached to the outer ring 54 to enclose the impeller 50.

A significant aspect of this invention resides in the configuration of the recess pocket 52, as shown in FIGS. 3 and 4. As particularly shown in FIG. 4, each pocket 52 includes at least three surfaces, namely a blade surface 56, the cylindrical surface 67 and a tangential surface 65. As shown by dotted line in FIG. 3, the blade surface 56, in one embodiment of this invention, is formed by a radius "r" rotated about a fixed point. The second surface of the pocket 62 is formed by the tangential surface 65, which intersects the leading surface 63 to define a tangential edge 60. As shown in FIG. 4, the tangential edge 60 lies at a tangent with respect to a protective cap 62 and, in particular, to the drive shaft 52. Further, the blade surface 56 intersects the leading surface 63 to define a radial edge 58, that lies along a line passing radially through the axis of the drive shaft 52. The pocket 56 is enclosed by the outer ring 54, which defines the cylindrical surface 67. As indicated in FIG. 4, the cylindrical surface 67 and the tangential surface 65 are disposed substantially perpendicular with respect to the leading surface 63. By contrast, the blade surface 56 is curved and a tangent to that curved blade surface 56 disposed at the edge 58 forms an angle "a" with respect to the leading surface 63, as shown in FIG. 3. Further, a tangent to the curved surface 56 disposed at its deepest point intersects a line disposed substantially parallel with the leading surface 63 at an angle "b" in FIG. 3.

The configuration of the blade surface 56 and its disposition with respect to the leading surface 63 has been found, in accordance with the teachings of this invention, to be critical in order to maximize the slurry flow rate through the pump 10. A pump 10, as shown in the drawings, was constructed wherein the inlet duct 36 has a diameter of 2 inches and the impeller 50 a diameter of 6 inches to achieve a flow rate of 225 gallons per minute of water (without solids therein) with angle "a" set at 30°, angle "b" set at 24°, and the radius "r" set at $2\frac{5}{8}$ inches. Changes of these angles either to increase or to decrease them decreases the flow rate significantly. For example, when angles "a" and "b" were set respectively at 15° and 20°, the flow rate decreased by at least 10%. The results of this invention were achieved with an electric motor driving the drive pulley 53 of relatively low horsepower, e.g., 25 horsepower. A pump 10 of the illustrative dimensions and with the blade surface 56 configured as set out above was tested in a mining environment. In particular, a 25-foot-long inlet conduit 12 was connected to the inlet 14. A remote end of the inlet conduit 12 was laid on a creek bed and was able to draw gold nuggets as large as 2 ounces at a distance of 18 inches. Significantly, the impeller 50 of this invention was able to establish a vortex not only within the pump chamber 38, but also extending through the inlet 14 and the inlet conduit 12 to a point spaced from the end of the conduit 12. It was evident from these tests that the slurry, as drawn through the inlet conduit 12, was rotating in configuration of a vortex, such action being similar to that of a hurricane, wherein particles are drawn toward the axis of the slurry vortex. Observation of these tests indicated that relatively large nuggets, weighing as much as 2 ounces, were drawn up into the vortex and were drawn through the inlet conduit 12, the inlet duct 36, and into the pump chamber 36 to be discharged from the outlet duct 24. Illustratively, the slurry and solid materials were discharged via the outlet conduit 28 into a suitable container, whereby the liquid would drain away leaving the solid materials free and collected therein.

Figure 5:
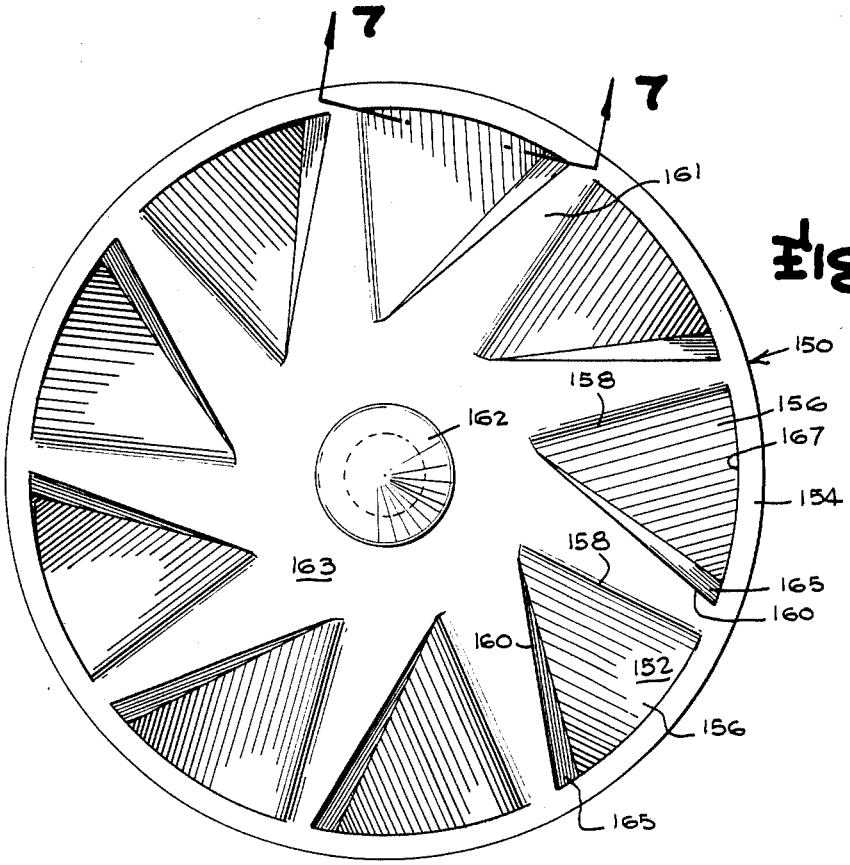
FIG. 5 is a front view of an impeller in accordance with a further embodiment of this invention.
Figure 6:
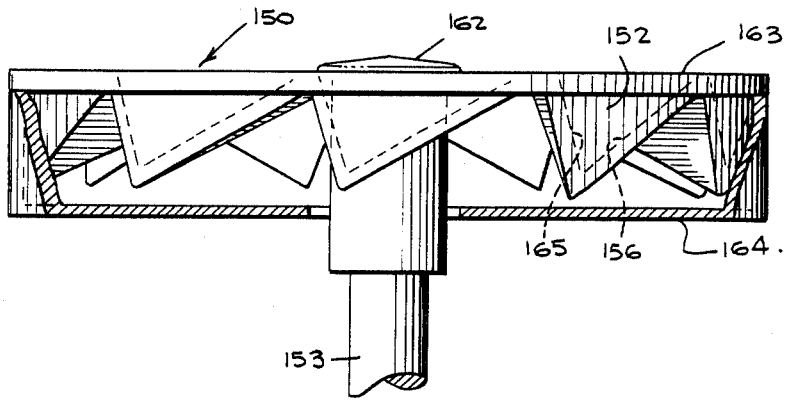
FIG. 6 is a side, partially sectioned view of the impeller of FIG. 5.
Figure 7:
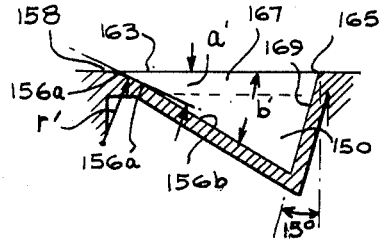
FIG. 7 is a sectioned view of a recess pocket as taken along line 7—7 of FIG. 5.

Referring now to FIGS. 5, 6 and 7 there is shown a further embodiment of this invention, wherein like characters are identified with similar numbers, but in the hundred series. The impeller 150 is of a larger diameter than that of the impeller 50. In accordance with the teachings of this invention, the configuration of each of the plurality of recessed pockets 152 within the impeller 150 remains substantially the same, i.e., by the dimensions of each pocket 152 remain substantially the same. Therefore, it is necessary to increase the number of pockets 152, e.g., 9, as compared to the number of pockets 52, e.g., 6, within the impeller 50. As shown in FIG. 5, each pocket 152 is comprised of three surfaces, namely the blade surface 156, the cylindrical surface 167, and the tangential surface 165. The blade surface 156, as best shown in FIG. 7, differs from that configuration as shown in FIG. 3. In particular, the blade surface 156 includes a first curved portion **156*a* that is defined as the curve of a radius r′ about a fixed point. The fixed point of rotation is determined such that a tangent to the curved portion 156*a* disposed at the radial edge 158 forms an angle a′ with respect to the leading surface 163. The trailing portion 156*b* of the blade surface 156 is substantially planar and forms an angle b′ with respect to the leading surface 163**. Illustratively, the radius r′ is set to equal $2\frac{5}{8}$ inches, angle a′ equals 24°, and angle b′ equals 30° for optimum slurry velocity.

In each of the embodiments of FIGS. 2, 3, 4, and FIGS. 5, 6 and 7, the blade surface 56 resembles the surface of an aircraft wing, i.e., the leading edge **156*a* of the blade is curved. In the embodiment of FIGS. 2, 3 and 4, the blade surface 56 is of a single curvature as defined by the radius R, whereas in the embodiment of FIGS. 5, 6 and 7, only an initial portion 156*a* is of a curved configuration as defined by the radius r′ and the remaining or trailing portion 156*b* is of a substantially planar configuration. The blade surface of this invention functions similar to that of an aircraft wing, wherein a fluid, namely the slurry, flows over the leading portion of the blade surface, thus, tending to increase the velocity flow of the slurry through the pump 10**. As a result, the rotational velocity of the fluid in the vortex established immediately above the leading surface of the impeller is increased, whereby the solid materials are substantially prevented from striking the impeller. Tests have been conducted upon the impeller of this invention, wherein the impeller is painted and then a slurry containing a relatively high percentage of solid materials, e.g., as high as 60% by weight, is pumped without putting any noticeable marks on the painted surface of the impeller of this invention. Further, the solid materials pump of this invention has been used to pump slurries of relatively high percentages by weight of solid materials for prolonged periods of time without showing any noticeable wear to the impeller. Such experience contrasts with the pumps of the prior art, wherein the impellers wear out after relatively short periods of time due to impact from the conveyed solid materials.

It should be understood that the foregoing description relates to the preferred embodiment of this invention and that modifications may be made therein without departing from the teachings of this invention as set forth in the appended claims.

I claim:

1. A rotary pump for pumping liquid and solid materials carried in suspension therein, said rotary pump comprising:

(a) an impeller having an axis of rotation:

(b) housing means comprising a swirl chamber, an impeller chamber for receiving said impeller, means for mounting said impeller within said impeller chamber for rotation in a given rotational direction about said axis, means for introducing the liquid and solid materials into said swirl chamber, and means for discharging the liquid and solid materials from said swirl chamber; and (c) said impeller comprising a surface exposed to said swirl chamber and disposed substantially outside said swirl chamber, and a plurality of enclosed pockets disposed in said exposed surface and recessed with respect to said swirl chamber, each of said recessed pockets comprising a blade surface intersecting said exposed surface to form an intersection line, said blade surface including a curved surface disposed adjacent said intersection line and disposed further away from said exposed surface and said swirl chamber as the distance from said axis increases, said intersection line oriented outward from said axis and leading said blade surface when considering said given rotational direction, whereby upon rotation of said impeller the liquid and suspended solid materials are formed into a swirling vortex of increased rotational velocity and establish a negative pressure in front of said exposed surface to substantially prevent the solid materials from striking said impeller.

2. The rotary pump as claimed in claim 1, wherein said curved surface is formed by a radius rotated about a fixed point.

3. The rotary pump as claimed in claim 2, wherein said radius is optimally $2\frac{5}{8}$ inches.

4. The rotary pump as claimed in claim 1, wherein said exposed surface is substantially planar.

5. The rotary pump as claimed in claim 4, wherein a line disposed tangential to said curved surface at said intersection line forms an angle with respect to said exposed surface, said angle being substantially equal to 24°.

6. The rotary pump as claimed in claim 5, wherein said blade surface extends to a point of maximum depth with respect to said exposed surface and intersects a plane substantially parallel with respect to said exposed surface at a second angle, said second angle being substantially equal to 30°.

7. The rotary pump as claimed in claim 4, wherein said impeller comprises a peripheral member of substantially cylindrical configuration and enclosing each of said recessed pockets.

8. The rotary pump as claimed in claim 7, wherein said peripheral member provides each of said recessed pockets with a second surface of substantially cylindrical configuration and disposed substantially perpendicular with respect to said exposed surface.

9. The rotary pump as claimed in claim 8, wherein each of said recessed pockets comprises a third surface intersecting said exposed surface to form a second intersection line and disposed substantially perpendicular with respect to said exposed surface, said second intersection line being disposed substantially tangential with respect to a circle having its center coincident with said axis of rotation.

10. The rotary pump as claimed in claim 9, wherein said first-mentioned intersection line is aligned radially to intersect said axis of rotation.

* * * * *